US005461279A

United States Patent [19]

Hasegawa

[11] Patent Number: 5,461,279

[45] Date of Patent: Oct. 24, 1995

[54] FLAT FLUORESCENT LAMP HAVING A LUMINESCENT SURFACE WITH A DIFFUSION GROOVE

[75] Inventor: Masayuki Hasegawa, Osaka, Japan

[73] Assignee: Sanyo Electric Co. Ltd., Osaka, Japan

[21] Appl. No.: 118,213

[22] Filed: Sep. 9, 1993

[30] Foreign Application Priority Data

| | | | |
|---|---|---|---|
| Sep. 10, 1992 | [JP] | Japan | 4-241943 |
| Sep. 10, 1992 | [JP] | Japan | 4-241944 |
| Sep. 16, 1992 | [JP] | Japan | 4-246617 |
| Sep. 16, 1992 | [JP] | Japan | 4-246618 |

[51] Int. Cl.[6] ..... H01J 63/04

[52] U.S. Cl. ..... 313/493; 313/292

[58] Field of Search ..... 313/484, 485, 313/493, 573, 574, 634, 292; 220/2.1 R, 2.3 A

[56] References Cited

U.S. PATENT DOCUMENTS

| | | | |
|---|---|---|---|
| 4,325,002 | 4/1982 | Kobale | 313/485 |
| 4,887,003 | 12/1989 | Parker | 313/634 |
| 4,920,298 | 4/1990 | Hinotani et al. | 313/493 |
| 5,207,607 | 5/1993 | Nagano | 313/634 |
| 5,229,685 | 7/1993 | Kim | 313/484 |
| 5,233,262 | 8/1993 | Lynn | 313/113 |
| 5,343,115 | 8/1994 | Anandan | 313/491 |

OTHER PUBLICATIONS

ITEJ Technical Report, vol. 12, No. 15, pp. 49–54.

*Primary Examiner*—Joseph Mancuso
*Assistant Examiner*—Tuan V. Ho
*Attorney, Agent, or Firm*—Nikaido Marmelstein Murray & Oram

[57] ABSTRACT

A flat fluorescent lamp which comprises first and second glass plates and at least one spacer interposed between the glass plates, the spacer projecting in the form of a rib from an inner surface of at least one of the two glass plates toward the other glass plate, the first glass plate being formed in a luminescent surface thereof with a diffusion groove positioned in corresponding relation to the spacer and V-shaped or curved in cross section.

8 Claims, 7 Drawing Sheets

FLAT FLUORESCENT LAMP HAVING A LUMINESCENT SURFACE WITH A DIFFUSION GROOVE

FIELD OF INDUSTRIAL APPLICATION

The present invention relates to flat fluorescent lamps and liquid crystal displays equipped with the lamp.

BACKGROUND OF THE INVENTION

Liquid crystal displays are widely used for image display devices such as television screens, video cameras, computers and computer displays. Since the liquid crystal display itself does not luminesce, a back light is generally used for illuminating the screen from behind the display to render the screen readily visible. Cold-cathode flat fluorescent lamps are used as such back lights.

The flat fluorescent lamp comprises two parallel glass plates each having a fluorescent coating over the inner surface and defining therebetween a space which is closed along the peripheries of the glass plates to form a discharge chamber, and a pair of discharge electrodes arranged inside the discharge chamber. For use with a liquid crystal display with a large screen, the flat fluorescent lamp also needs to have a large size approximately matching the size of the display screen, so that there arises a need to use glass plates of increased thickness and give the lamp a sufficient strength against pressure. This entails the problem that the flat fluorescent lamp itself becomes large-sized and heavier.

To overcome this problem, ITEJ Technical Report, Vol. 12, No. 15 (issued on Mar. 25, 1988), pp. 49–54, discloses a lamp. U.S. Pat. No. 4,920,298 discloses another lamp, which has the structure shown in FIGS. 13 and 14. This lamp comprises a front glass plate 10, a rear glass plate 12 and a glass frame 42 surrounding a space therebetween. Spacer rods 38 against pressure are provided between the front and rear glass plates 10, 12, whereby the lamp is given a strength to withstand the atmospheric pressure and made resistant to breaking without increasing the thickness of the front and rear glass plates 10, 12.

At the positions where the spacers are provided, however, the inner surface of the front glass plate 10 has no fluorescent layer 32, failing to luminesce, so that the shadows of the spacers are cast on the display screen. To give the luminescent surface of the flat fluorescent lamp luminance of the highest possible uniformity, ingenuity is exercised in diminishing luminance irregularities by forming a fluorescent coating 40 on the side faces of the spacer rods 38 (see FIG. 14) and providing a diffusion panel 22 (see FIG. 13) over the luminescent surface.

However, forming the fluorescent coating on the spacer rods requires additional work and results in an increased cost. Further when the luminescent surface of the flat fluorescent lamp has marked irregularities in luminance, the diffusion panel fails to eliminate the luminance irregularities if provided.

SUMMARY OF THE INVENTION

An object of the present invention is to provide a flat fluorescent lamp wherein spacers are interposed between front and rear glass plates and which has uniform luminance over the entire luminescent surface thereof with luminance irregularities of the surface diminished to the greatest possible extent.

Another object of the invention is to provide a liquid crystal display which is equipped with a flat fluorescent lamp having uniform luminance over the entire surface thereof.

The present invention provides a flat fluorescent lamp which comprises front and rear glass plates and at least one spacer interposed between the glass plates, the spacer projecting in the form of a rib from an inner surface of at least one of the front and rear glass plates toward the other glass plate, the front glass plate being formed in a luminescent surface thereof with a diffusion groove positioned in corresponding relation to the spacer and V-shaped or curved in cross section.

DESCRIPTION OF THE PREFERRED EMBODIMENTS

Figure 5:
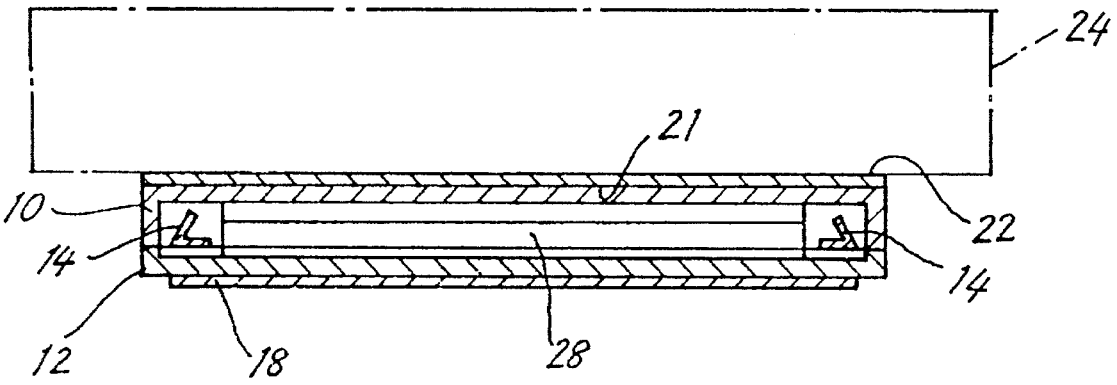
FIG. 5 is a view in section taken along the line V—V in FIG. 2.

FIG. 5 shows a flat fluorescent lamp which is provided with a diffusion panel 22 over a luminescent surface thereof and which is disposed as opposed to the rear side of effective screen area of a liquid crystal display 24 to make the images on the display 24 clearly visible. However, the flat fluorescent lamp itself is of course usable as a light source.

Figure 1:
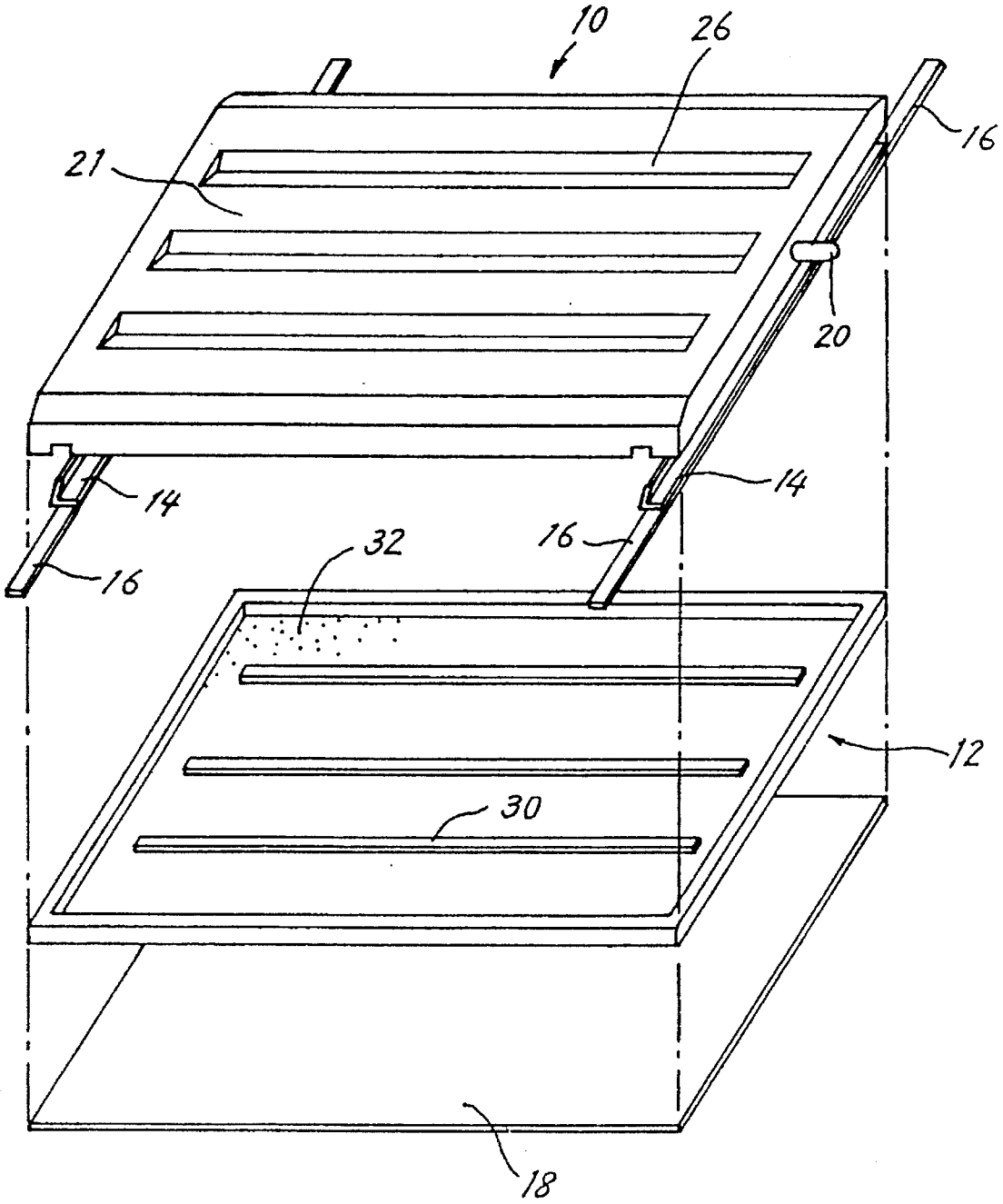
FIG. 1 is an exploded perspective view of a flat fluorescent lamp embodying the invention.
Figure 2:
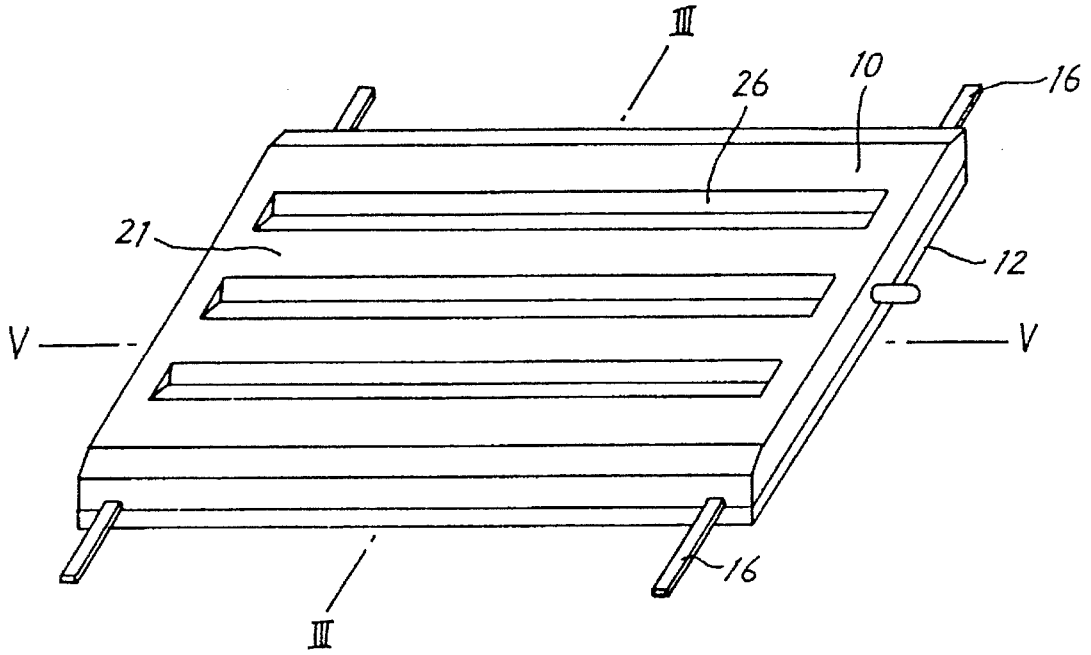
FIG. 2 is a perspective view of the flat fluorescent lamp of the invention as assembled.
Figure 3:
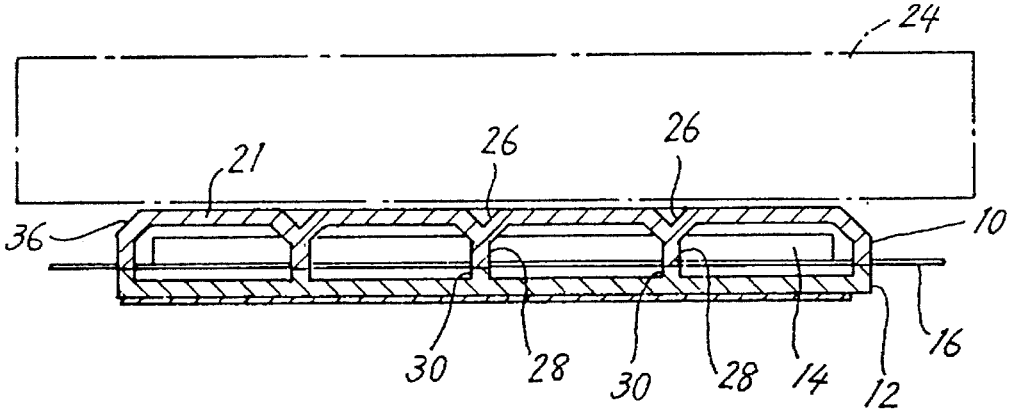
FIG. 3 is a view in section taken along the line III—III in FIG. 2.
Figure 6:
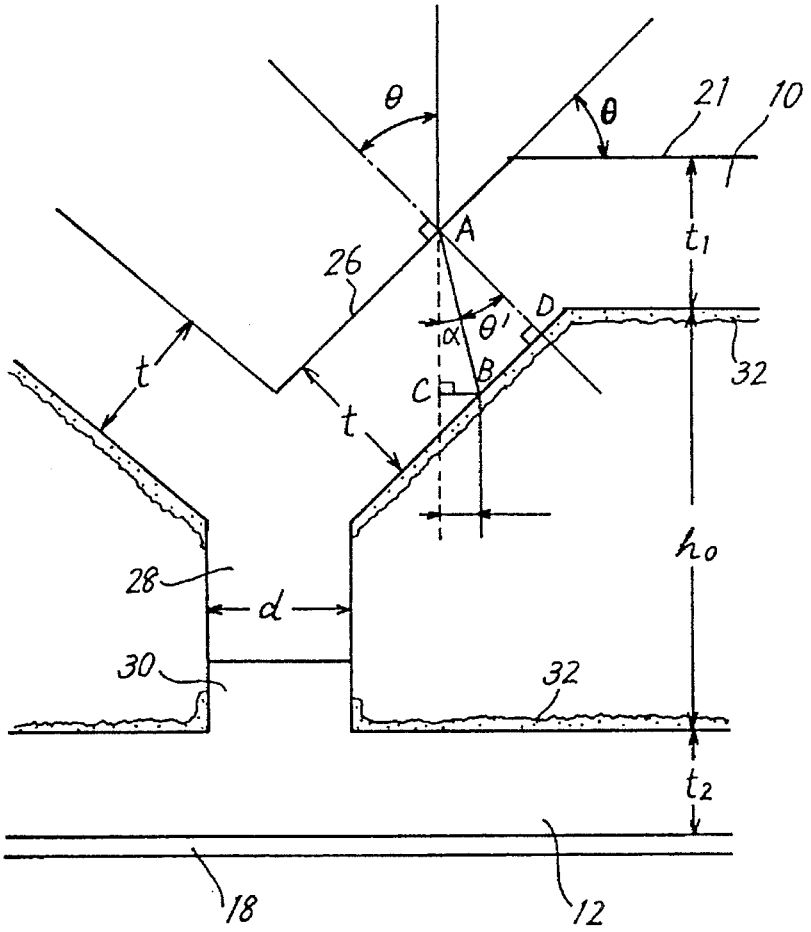
FIG. 6 is an enlarged view in section of a spacer and a grooved portion shown in FIG. 3.

With reference to FIGS. 1 and 2, the flat fluorescent lamp comprises a first glass plate 10 having a phosphor or fluorescent layer 32 over an inner surface thereof and a front surface providing a luminescent surface 21, and a second glass plate 12 having an inner surface formed with a fluorescent layer 32. These glass plates 10, 12 are arranged in register with each other and have their peripheries thermally joined together with frit glass to define an airtight space serving as a discharge chamber. A pair of discharge electrodes 14, 14 are arranged as opposed to each other within the discharge chamber. After the discharge chamber has been evacuated to a vacuum through a tip tube 20, argon gas and mercury are injected into the chamber through the tip tube 20, which is then sealed off with the chamber maintained at a low pressure of several tens of torr. The discharge electrode 14 is shaped to a predetermined cross sectional form readily permitting a discharge, and has connected its opposite ends to lead pieces 16, which are held between cutout portions formed in the peripheral walls of the first and second glass plates to retain the electrode 14 within the discharge chamber. As shown in FIG. 3, opposed pairs of riblike spacers 28, 30 project respectively from the inner surfaces of the first and second glass plates 10, 12, the spacers 28, 30 of each pair butting against each other to withstand the compressive atmsopheric pressure acting on the glass plates 10, 12. Provided on the rear side of the second glass plate 12 is an auxiliary electrode 18 for facilitating initiation of discharge across the electrodes 14, 14. While the structure of the flat fluorescent lamp described above is already known, the present invention is characterized in that as shown in FIG. 6, the luminescent surface 21 of the first glass plate 10 is formed with grooves 26 positioned as opposed to the respective spacers 28, having a tapered bottom and flaring outward. During the discharge of the flat fluorescent lamp, ultraviolet radiation fills up the interior of the discharge chamber, exciting the fluorescent layer 32 to cause luminescence. Since the path of travel of rays is reversible, a ray will be considered which is incident on the luminescent surface 21 perpendicular thereto from the front of the first glass plate 10 as shown in FIG. 6. The ray is incident on point A of the groove 26 at an angle of incidence of θ, travels through the glass at an angle of refraction of θ' with respect to the axis of the incident ray and emerges from point B into the discharge chamber in parallel to the incident ray. The incident ray is refracted by the groove 26 of the first glass plate 10 and displaced by the distance ds between BC. The distance ds can be calculated from the following equations.

Suppose θ is the angle of incidence, θ' is the angle of refraction, α is the angle BAC, t is the thickness (=AD) of the first glass plate at the grooved portion 26 and n is the refractive index of the glass.

The refractive index of the glass has the following relationship with the angle of incidence and the angle of refraction.

$$n = \frac{\sin\theta}{\sin\theta'} \tag{1}$$

From the right triangle ABD, $$AB = AD \cdot \frac{1}{\cos\theta'}$$

From the right triangle ABC, $$BC = AB \cdot \sin\alpha$$

Since α=θ−θ' from FIG. 6, $$BC = AB \cdot \sin(\theta - \theta') = AD \cdot \frac{\sin(\theta - \theta')}{\cos\theta'}$$

Hence $$ds = t \cdot \frac{\sin(\theta - \theta')}{\cos\theta'} \tag{2}$$

The refractive index of the glass is 1.5. The angle of incidence θ of light is the inclination of the slope of the grooved portion 26. The displacement ds of light is therefore calculated from Equations (1) and (2) as listed in Table 1 below when the thickness t of the grooved portion 26 of the first glass plate and the inclination θ of the slope of the grooved portion 26 are given.

Table 2 shows the dimensions of the flat fluorescent lamp.

TABLE 1

| | t (mm) | ds (mm) |
|---|---|---|
| θ = 45 deg | 4.56 | 1.5 |
| | 3.04 | 1.0 |
| | 2.27 | 0.75 |
| | 1.52 | 0.5 |
| θ = 60 deg | 2.93 | 1.5 |
| | 1.95 | 1.0 |
| | 1.46 | 0.75 |
| | 0.976 | 0.5 |

TABLE 2

| | | |
|---|---|---|
| Thickness of first glass plate | $t_1$ | 1.0 (mm) |
| Thickness of second glass plate | $t_2$ | 1.0 |
| Plate thickness of grooved portions | t | 1.17 |
| Inside height of fluorescent lamp | $h_0$ | 4.0 |
| Outside height of fluorescent lamp | | 6.0 |
| Length of fluorescent lamp | | 100 |
| Width of fluorescent lamp | | 75 |
| Width of spacers | d | 1.0 |

Table 1 reveals that the perpendicular ray from above is displaced by 0.5 mm when θ=45 deg and t=1.52 mm.

Accordingly, when the width d of the spacer 28 of the first glass plate is 2×ds=2×0.5=1 mm, the spacer 28 is invisible even if viewed from immediately thereabove. In actuality, the spacer is generally viewed from oblique directions, so that the plate thickness t needs to be slightly greater. An increase in the plate thickness t results in a corresponding increase in the displacement ds to provide an allowance for the actual width d of the spacer portion, increasing the angle at which the shadow of the spacer portion is invisible, i.e., the angle of field.

When the inclination θ of slopes of the grooved portions 26 was set to 60 deg with the plate thickness t of these portions set to 1.17 mm with the present embodiment, it was possible to reduce the thicknesses $t_1$ and $t_2$ of the first and second glass plates to as small as about 1 mm although conventional flat fluorescent lamps having no spacers required a plate thickness of at least 2.5 mm.

Figure 7:
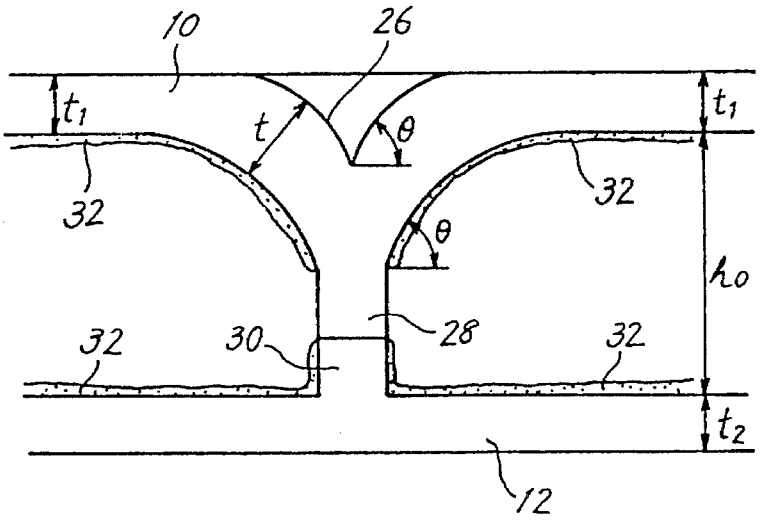
FIG. 7 is an enlarged view in section of a spacer and a grooved portion according to another embodiment.

FIG. 7 shows a groove 26 which is defined by curved surfaces so as not to permit the spacer portion to project a shadow when the fluorescent lamp is viewed from the front and to achieve a further diminution in luminance irregularities. The curved surfaces defining the groove 26 are parabolic in cross section. The parabola forming the curved outer surface is expressed by $$Y = \tfrac{1}{2}X^2$$

The curve of the curved inner surface of the first glass plate is expressed by $$Y = \tfrac{3}{8}X^2$$

With reference to FIG. 3, the luminescent surface of the first glass plate 10 has corners 36 inclined inward, whereby the light emitted by the fluorescent layer is deviated outward to illuminate the liquid crystal display 24 on the same principle as already described with respect to the groove 26 in the luminescent surface. This enlarges the effective illumination range of the flat fluorescent lamp.

Figure 4:
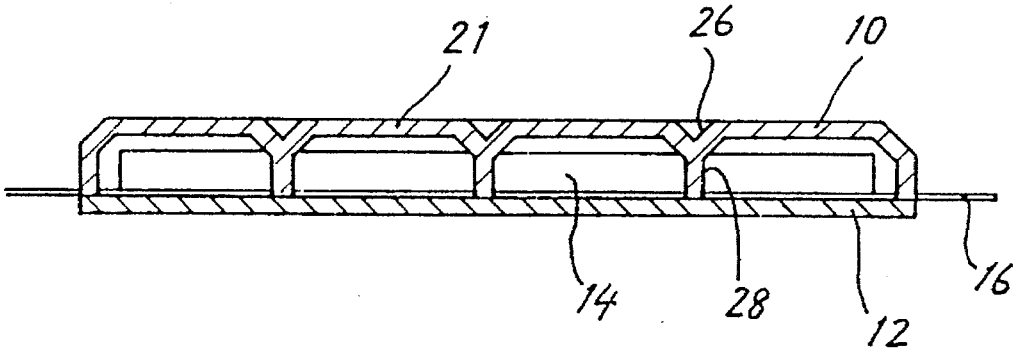
FIG. 4 is a sectional view of a flat fluorescent lamp as another embodiment.

With reference to FIG. 4, a first glass plate 10 has a peripheral wall and spacers 28 which extend to a flat inner surface of a second glass plate 12. With this embodiment, a planar glass sheet is usable as it is as the second glass plate. Although the spacers of two glass plates need to be positioned in register with the embodiment of FIG. 1, this procedure can be omitted with the present embodiment, which is therefore easy to fabricate.

Figure 11:
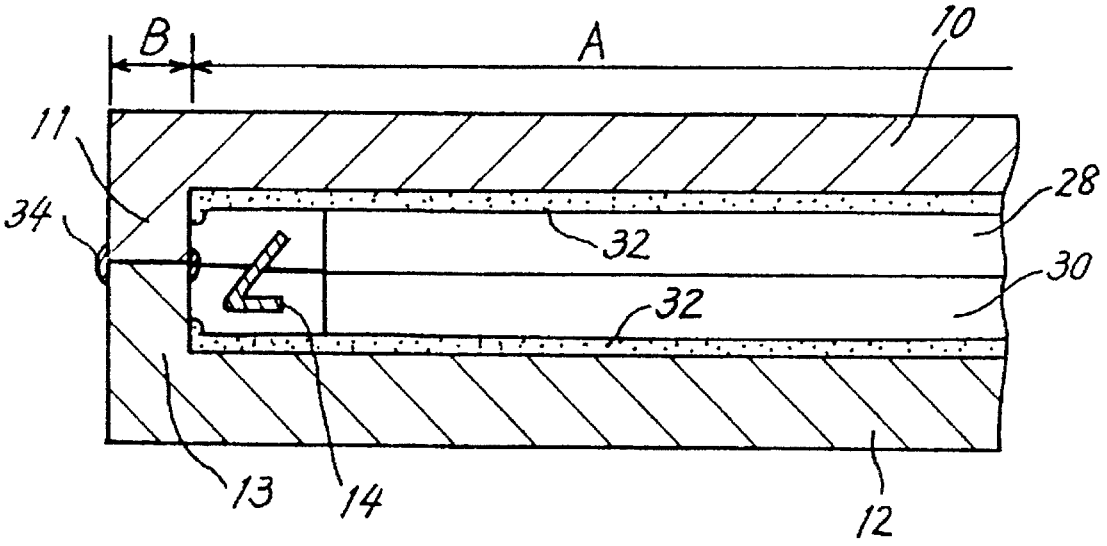
FIG. 11 is an enlarged view in section of a corner portion of another embodiment.

FIG. 11 shows another embodiment of the invention. This embodiment is an improvement over the conventional flat fluorescent lamp shown in FIG. 12.

Figure 12:
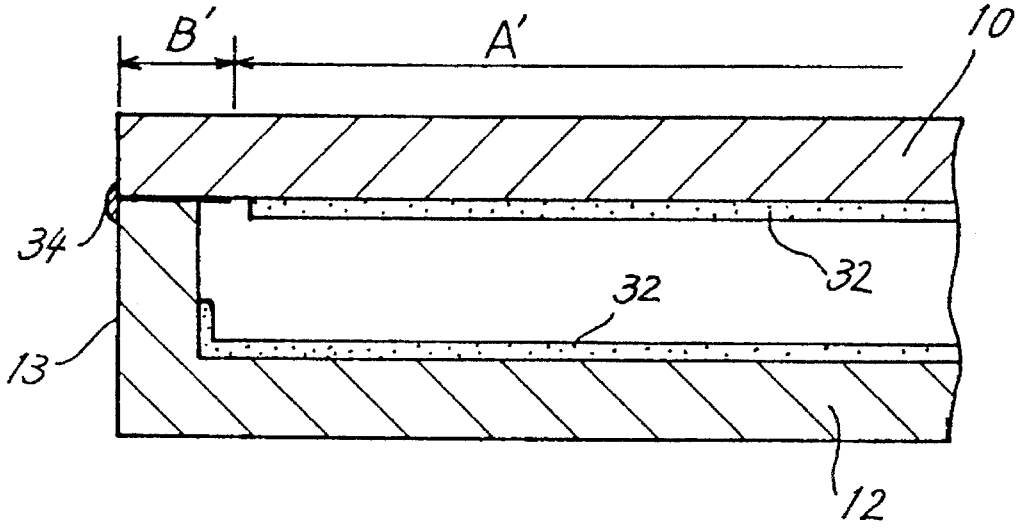
FIG. 12 PRIOR ART
FIG. 12 is a sectional view of a corner portion of a conventional example.

The flat fluorescent lamp shown in FIG. 12 comprises a second glass plate 12 having a wall 13 projecting from the periphery thereof and joined at its outer end to the inner surface of a planar first glass plate 10 with frit glass 34 by melting. The frit glass 34 melts, partly flowing out into the discharge chamber before solidification, so that the fluorescent layer 32 to be provided over the inner surface of the first glass plate 10 is formed as spaced apart from the joint by a distance corresponding to the flowing-out portion of frit glass 34. Consequently, a wide region B' including the flowing-out frit glass portion does not luminesce to result in a decreased effective luminescent area A'.

FIG. 11 shows first and second glass plates 10, 12 respectively having peripheral walls 11, 13 butting against each other and joined together with frit glass 34 by melting. The frit glass 34 is disposed at the outer ends of the peripheral walls 11, 13 and does not flow out over the surface coated with the fluorescent layer 32. The layer 32 can therefore be formed over the inner surface of the first glass plate 10 including every corner thereof. This affords a smaller nonluminescent region B and a larger effective luminescent area A for illuminating the liquid crystal display over an increased effective screen area.

Figure 8:
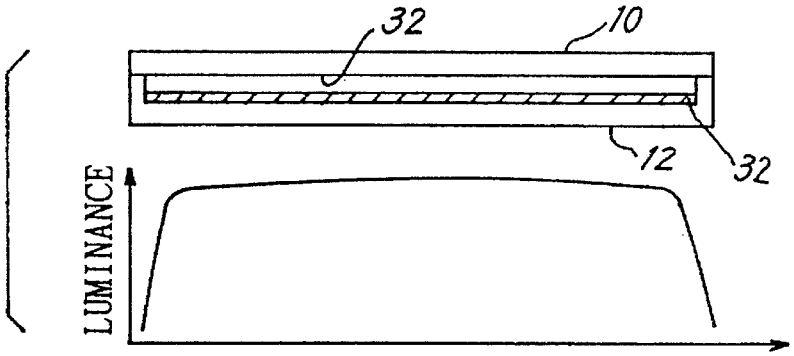
FIG.8 PRIOR ART
FIG. 8 to FIG. 10 are sectional views and luminance distribution diagrams of different types of flat fluorescent lamps, FIGS. 8 and 9 showing conventional examples, FIG. 10 showing the lamp of the invention.
Figure 9:
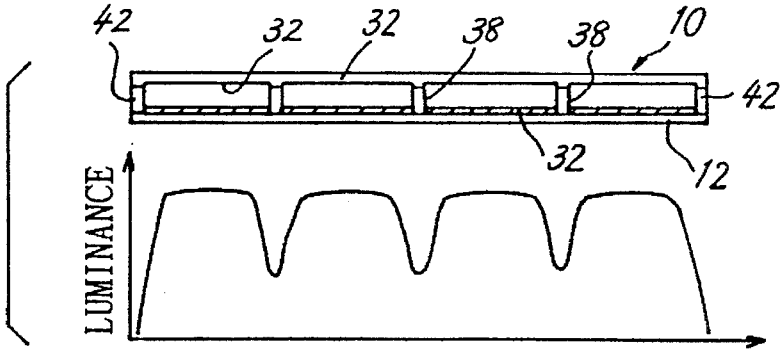
FIG.9 PRIOR ART
Figure 10:
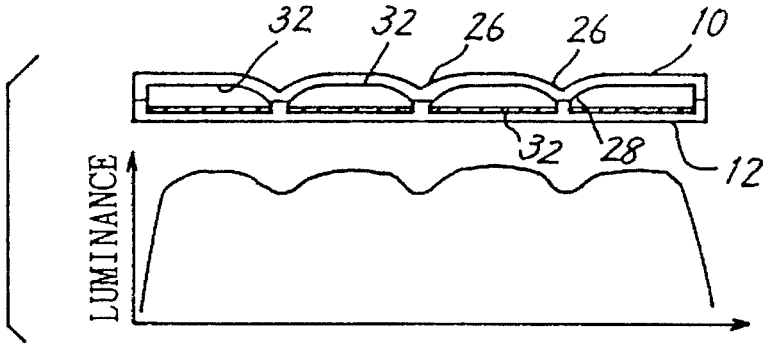

FIGS. 8 to 10 show flat fluorescent lamps of different structures and the respective luminance distributions thereof.

FIG. 8 shows a conventional lamp having no spacers in its discharge chamber. With no spacers provided, the illustrated structure is not suited to large lamps, but the fluorescent layer 32 formed over the entire inner surface of the first glass plate luminesces uniformly.

Figure 13:
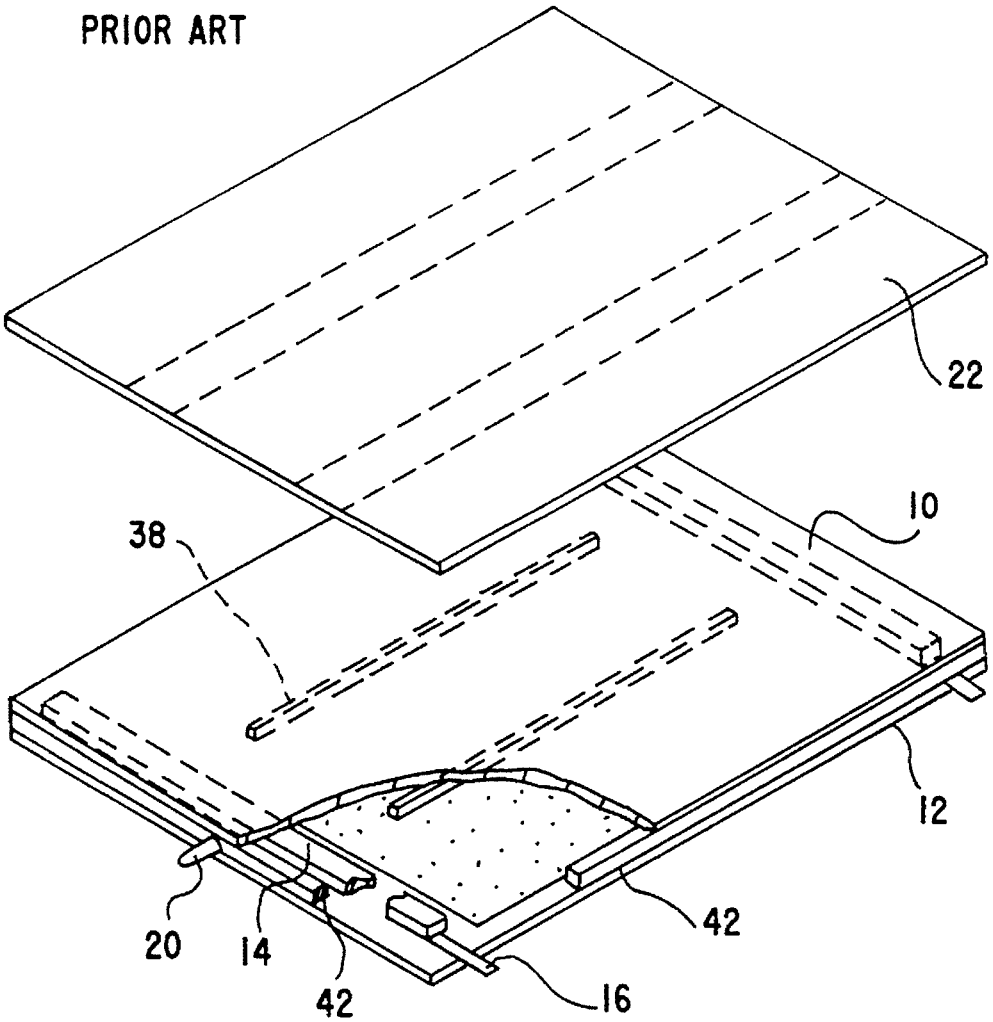
FIG.13 PRIOR ART
FIG. 13 is a perspective view partly broken away and showing a flat fluorescent lamp of the prior art.
Figure 14:
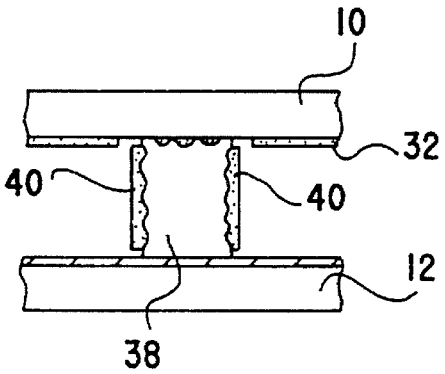
FIG.14 PRIOR ART
FIG. 14 is an enlarged view in section taken along the crossing line transversing the spacer in FIG. 13.

FIG. 9 shows a conventional lamp having spacer rods 38 and corresponding to FIG. 13. The lamp has the advantage of being of great strength and available in large sizes, whereas the luminescence involves marked irregularities in luminance since no light is emitted from the positions of the spacer rods 38.

FIG. 10 shows the lamp of the present invention. Since the luminescent surface has grooves 26 positioned in corresponding relation to the spacers 28, the light emitted by the fluorescent layer 32 is projected to above the spacers 28 on refraction to remarkably diminish luminance irregularities.

The foregoing description and the drawings are given for a better understanding of the present invention and therefore should not be interpreted as limiting the scope of the invention as defined in the appended claims.

Other embodiments can of course be prepared by one skilled in the art without departing from the scope defined by the claims.

What is claimed is:

1. A flat fluorescent lamp comprising a first glass plate having a front surface serving as a luminescent surface and a fluorescent layer formed over an inner surface thereof, a second glass plate having a fluorescent layer over an inner surface thereof and disposed as opposed to the first glass plate, the two glass plates having their peripheries hermetically joined together to define a discharge chamber inside thereof, a pair of discharge electrodes opposed to each other and arranged within the discharge chamber at opposite sides thereof, and at least one linear spacer provided between and extending to the discharge electrodes and supporting the two glass plates, characterized in that the spacer projecting in the form of a rib from the inner surface of at least one of the two glass plates toward the other glass plates, the first glass plate being formed in the luminescent surface thereof with a diffusion groove positioned in opposing relation to the spacer and extending in the same direction of the spacer, the diffusion groove having a diminished bottom and flaring outward in cross section.

2. A flat fluorescent lamp as defined in claim 1 wherein the diffusion groove is approximately V-shaped in cross section.

3. A flat fluorescent lamp as defined in claim 1 wherein the diffusion groove has opposite sides each defined by a curved surface.

4. A flat fluorescent lamp as defined in claim 1 wherein the spacer is formed by two ribs projecting respectively from the inner surfaces of the two glass plates and butting against each other.

5. A flat fluorescent lamp as defined in claim 1 wherein the inner surface of the second glass plate is planar, and the first glass plate has the spacer extending in the form of a rib from the inner surface thereof to the inner surface of the second glass plate.

6. A flat fluorescent lamp as defined in claim 1 wherein the luminescent surface of the first glass plate has a peripheral corner portion in the form of a slanting face.

7. A flat fluorescent lamp as defined in claim 1 wherein the luminescent surface of the first glass plate has a peripheral corner portion in the form of a curved face.

8. A flat fluorescent lamp as defined in claim 1 which is equipped with a liquid crystal display over the luminescent surface of the first glass plate with a diffusion panel interposed therebetween.

* * * * *